US009470070B2

(12) United States Patent
Keinath et al.

(10) Patent No.: US 9,470,070 B2
(45) Date of Patent: Oct. 18, 2016

(54) BUBBLE PUMP UTILIZATION FOR VERTICAL FLOW LINE LIQUID UNLOADING

(71) Applicants: Brendon L. Keinath, Houston, TX (US); Jason W. Lachance, Magnolia, TX (US)

(72) Inventors: Brendon L. Keinath, Houston, TX (US); Jason W. Lachance, Magnolia, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 14/835,781

(22) Filed: Aug. 26, 2015

(65) Prior Publication Data

US 2016/0102531 A1 Apr. 14, 2016

Related U.S. Application Data

(60) Provisional application No. 62/062,341, filed on Oct. 10, 2014.

(51) Int. Cl.

| | |
|---|---|
| ***E21B 17/01*** | (2006.01) |
| ***E21B 43/01*** | (2006.01) |
| ***E21B 37/00*** | (2006.01) |
| ***E21B 43/00*** | (2006.01) |

(52) U.S. Cl.

CPC ..... *E21B 43/01* (2013.01); *E21B 17/01* (2013.01); *E21B 37/00* (2013.01); *E21B 43/00* (2013.01)

(58) Field of Classification Search

CPC .... E21B 17/01; E21B 41/0007; E21B 43/01; E21B 43/122

USPC ..... 166/367

See application file for complete search history.

(56) References Cited

U.S. PATENT DOCUMENTS

| | | | | |
|---|---|---|---|---|
| 4,091,881 | A * | 5/1978 | Maus | E21B 21/08 175/25 |
| 4,589,434 | A * | 5/1986 | Kelley | E21B 43/01 137/1 |
| 4,647,272 | A * | 3/1987 | Brown | F04F 1/18 417/109 |
| 4,666,377 | A * | 5/1987 | Brown | F04F 1/18 417/53 |
| 5,904,209 | A * | 5/1999 | Kenworthy | E21B 43/38 166/242.3 |
| 5,950,651 | A | 9/1999 | Kenworthy et al. | 137/13 |
| 6,109,829 | A * | 8/2000 | Cruickshank | B29C 63/34 405/158 |
| 7,279,052 | B2 * | 10/2007 | Kinnari | F16L 55/38 134/22.12 |
| 7,464,762 | B2 * | 12/2008 | Duret | E21B 43/01 137/1 |

(Continued)

FOREIGN PATENT DOCUMENTS

| | | | | |
|---|---|---|---|---|
| GB | 2280460 | A * | 2/1995 | E21B 17/01 |

OTHER PUBLICATIONS

Chisholm, D. (1983) "Two-phase Flow in Pipelines and Heat Exchangers," London, New York, G. Godwin in association with *The Institution of Chemical Engineers*, 1983, p. 32.

*Primary Examiner* — Matthew R Buck

(74) *Attorney, Agent, or Firm* — ExxonMobil Upstream Research Company Law Department

(57) ABSTRACT

A method, including: performing dual-side depressurization on a hydrate blockage in a subsea flow line, wherein dual-side depressurization includes, reducing pressure on a topside of the hydrate blockage in the subsea flow line by removing liquid from within a subsea riser with a bubble pump that has a first end in fluid communication with the liquid within the subsea riser, reducing pressure on a backside of the hydrate blockage, and concurrently controlling the reduction in pressure on the topside of the hydrate blockage and the backside of the hydrate blockage.

14 Claims, 4 Drawing Sheets

(56) References Cited

U.S. PATENT DOCUMENTS

| | | | | |
|---|---|---|---|---|
| 7,650,944 | B1 * | 1/2010 | Boyle | B63B 27/24 137/15.12 |
| 7,815,744 | B2 * | 10/2010 | Abney | F16L 55/26 134/22.11 |
| 8,220,552 | B2 * | 7/2012 | Kinnari | F17D 1/05 166/344 |
| 2007/0098375 | A1 | 5/2007 | Kinnari et al. | |
| 2010/0047022 | A1 * | 2/2010 | Le Moign | E02F 3/907 405/184.1 |
| 2010/0252260 | A1 | 10/2010 | Fowler et al. | |
| 2012/0103621 | A1 * | 5/2012 | Kanstad | E21B 36/001 166/344 |
| 2013/0277047 | A1 | 10/2013 | Kuhn de Chizelle et al. | 166/250.12 |
| 2014/0169989 | A1 * | 6/2014 | Nakamura | E02F 3/8833 417/54 |
| 2014/0352973 | A1 * | 12/2014 | Dwars | E21B 36/005 166/335 |
| 2015/0184490 | A1 * | 7/2015 | Kanstad | F28G 9/00 166/335 |

* cited by examiner

BUBBLE PUMP UTILIZATION FOR VERTICAL FLOW LINE LIQUID UNLOADING

CROSS REFERENCE TO RELATED APPLICATIONS

This application claims the priority benefit of U.S. Provisional Patent Application No. 62/062,341 filed Oct. 10, 2014 entitled BUBBLE PUMP UTILIZATION FOR VERTICAL FLOW LINE LIQUID UNLOADING, the entirety of which is incorporated herein.

TECHNOLOGICAL FIELD

Exemplary embodiments described herein pertain to flow assurance in offshore hydrocarbon production. More specifically, exemplary embodiments described herein use a bubble pump to allow for dual side depressurization and hydrate remediation.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

Hydrate blockages are one of the most common flow assurance challenges posed with subsea production. This is a result of high pressures and cold temperatures typically experienced in these environments. Hydrate blockages can lead to significant production down times which equates to significant dollars in differed production. If the hydrate blockage is severe, remediation efforts can be extremely costly and given the value of the asset, a blockage, if unable to remediate, can lead to the loss of an asset.

One type of hydrate remediation is dual side de-pressurization. Lowering the pressure below the hydrate equilibrium curve will result in the eventual dissociation of a hydrate plug. The speed at which the hydrate dissociates is a strong function of the pressure that can be obtained. For example, it has been observed that obtaining a pressure that is about 200 psi or lower, can result in the dissociation process taking hours instead of days under certain conditions.

Dual side de-pressurization is not always possible in subsea applications and single side depressurization is used. Single side depressurization typically takes much longer and poses additional safety concerns since the hydrate will experience a pressure differential and could potentially become dislodged and act like a projectile in the flow line.

U.S. Pat. No. 5,950,651, which is hereby incorporated by reference in its entirety, describes transport of multi-phase flow in small tubes.

U.S. Pat. No. 5,904,209, which is hereby incorporated by reference in its entirety, describes bubble pump technology in the application of removing liquids from a well to increase gas flow.

U.S. Patent Publication 2013/0277047, which is hereby incorporated by reference in its entirety, describes using micro-tubing devices to deploy fluids (chemicals).

SUMMARY

A method, including: performing dual-side depressurization on a hydrate blockage in a subsea flow line, wherein dual-side depressurization includes, reducing pressure on a topside of the hydrate blockage in the subsea flow line by removing liquid from within a subsea riser with a bubble pump that has a first end in fluid communication with the liquid within the subsea riser, reducing pressure on a backside of the hydrate blockage, and concurrently controlling the reduction in pressure on the topside of the hydrate blockage and the backside of the hydrate blockage.

In some embodiments, the concurrently controlling includes maintaining a pressure differential on the topside and the backside of the hydrate blockage within a predetermined range.

In some embodiments, the predetermined range is +/−10%.

In some embodiments, the concurrently controlling includes reducing the pressure on the topside and the backside of the hydrate blockage by about 200 psi.

In some embodiments, the reducing pressure on the topside of the hydrate blockage includes controlling a position of the bubble pump within the riser to maintain fluid communication between the first end of the bubble pump and the liquid within the riser as the liquid is removed from the riser.

In some embodiments, the reducing pressure on the backside of the hydrate includes bleeding gas from the flow line.

In some embodiments, the method further includes injecting a gas below the first end of the bubble pump.

In some embodiments, the injecting the gas includes injecting the gas through gas injection ports disposed in the riser.

In some embodiments, the method further includes heating the liquid in the riser to generate gas bubbles below the first end of the bubble pump.

In some embodiments, the heating the liquid in the riser includes heating at a bottom of the riser.

In some embodiments, the method includes resuming hydrocarbon management after the hydrate blockage dissolves.

BRIEF DESCRIPTION OF THE DRAWINGS

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles.

DETAILED DESCRIPTION

Exemplary embodiments are described herein. However, to the extent that the following description is specific to a particular embodiment, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

The present technological advancement can provide a reliable remediation technique to ensure removal of hydrate blockages. As discussed in more detail below, when a hydrate blockage is present in a flow line in sub-sea pipeline system, the present technological advancement enables dual side de-pressurization to be employed. The bubble pump can be used to remove a liquid column from the vertical riser, which lowers a pressure on one-side of the hydrate blockage (i.e., topside of the hydrate blockage). Pressure can be bled from another side of the hydrate blockage so that the pressure on both sides of the hydrate blockage is lowered in a controlled manner, which facilitates the quick (i.e., a few hours) disassociation of the hydrate blockage.

A benefit of using a system with the present technological advancement is the ability to finely control the amount of liquids displaced from the vertical riser. For example, the tube bundles forming a bubble pump can be slowly lowered as more and more liquids are displaced in the riser. This type of control is important to ensure that the pressure differential on the hydrate plug is not so great that it becomes dislodged and acts like a projectile.

Conventionally, wells may be lost because of a hydrate blockage. The present technological advancement provides the ability to remediate previously lost wells by removing the hydrate blockage and resuming hydrocarbon management. Advantageous, remediating lost wells eliminates the additional cost of drilling new off-shore wells and may increase hydrocarbon reserves. This can be very advantageous in hydrocarbon production in the arctic or other cold regions.

Furthermore, the bubble pump has no moving parts and eliminates a need to supply electrical power to a tool disposed in the riser.

Figure 1:
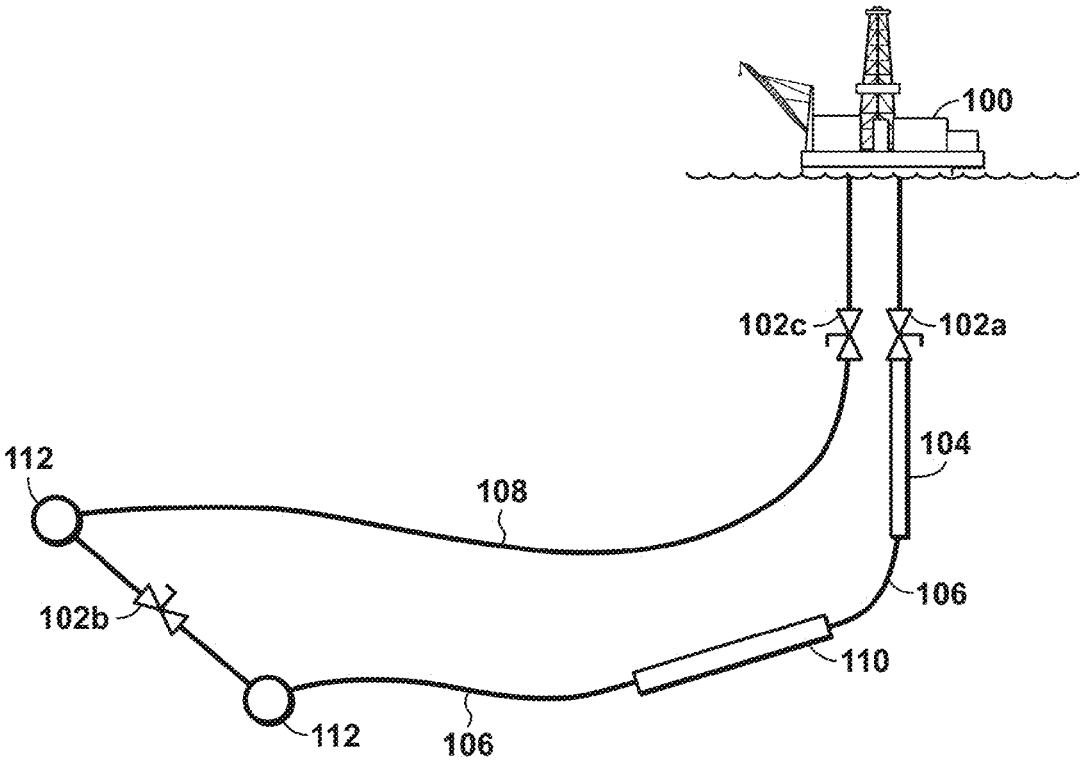
FIG. 1 is an exemplary schematic of a sub-sea pipeline system with a hydrate blockage.

FIG. 1 is an exemplary schematic of a sub-sea pipeline system with a hydrate blockage. This is a conventional arrangement well-known to those of ordinary skill the art. A high-level description is provided herein in order to facilitate understanding of the present technological advancement.

Platform 100 is a conventional offshore hydrocarbon platform (or colloquially an oil rig). This platform 100 can be any type of offshore platform, including but not limited to, fixed platforms, floating production systems, tension-leg platforms, gravity-based structures, or a drillship.

The platform 100 is connected, via valve 102*a*, to vertical riser 104. The vertical riser 104 is a conduit that transfers materials from the seafloor to production and drilling facilities of platform 100, as well as from the facilities to the seafloor. A liquid column is within the riser. The present technological advancement can be used with known riser types, which include but are not limited to, attached risers, pull tube risers, flexible risers, and drilling risers.

The system shown in FIG. 1 is a multi-flow line arrangement. While two flow lines 106 and 108 are shown, additional flow lines may be included. In the present example, flow line 106 is connected to a bottom end of the riser 104 and to flow line 108 via valve 102*b*. The other end of flow line 108 is connected to the platform 100 via valve 102*c*. Flow line 106 is depicted with hydrate blockage 110. Circles 112 in FIG. 1 are wells or manifolds (basically where produced oil and gas are feeding into the system).

Figure 2B:
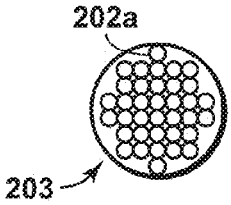
FIG. 2B is an exemplary cross-section of an output end of the bubble pump device.
Figure 2D:
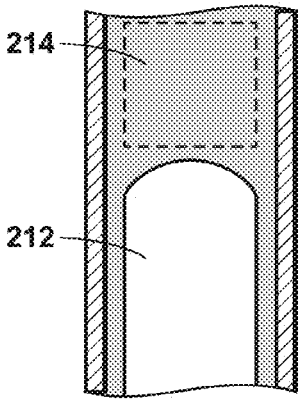
FIG. 2D is an exemplary section of a tube in the bubble pump.
Figure 2A:
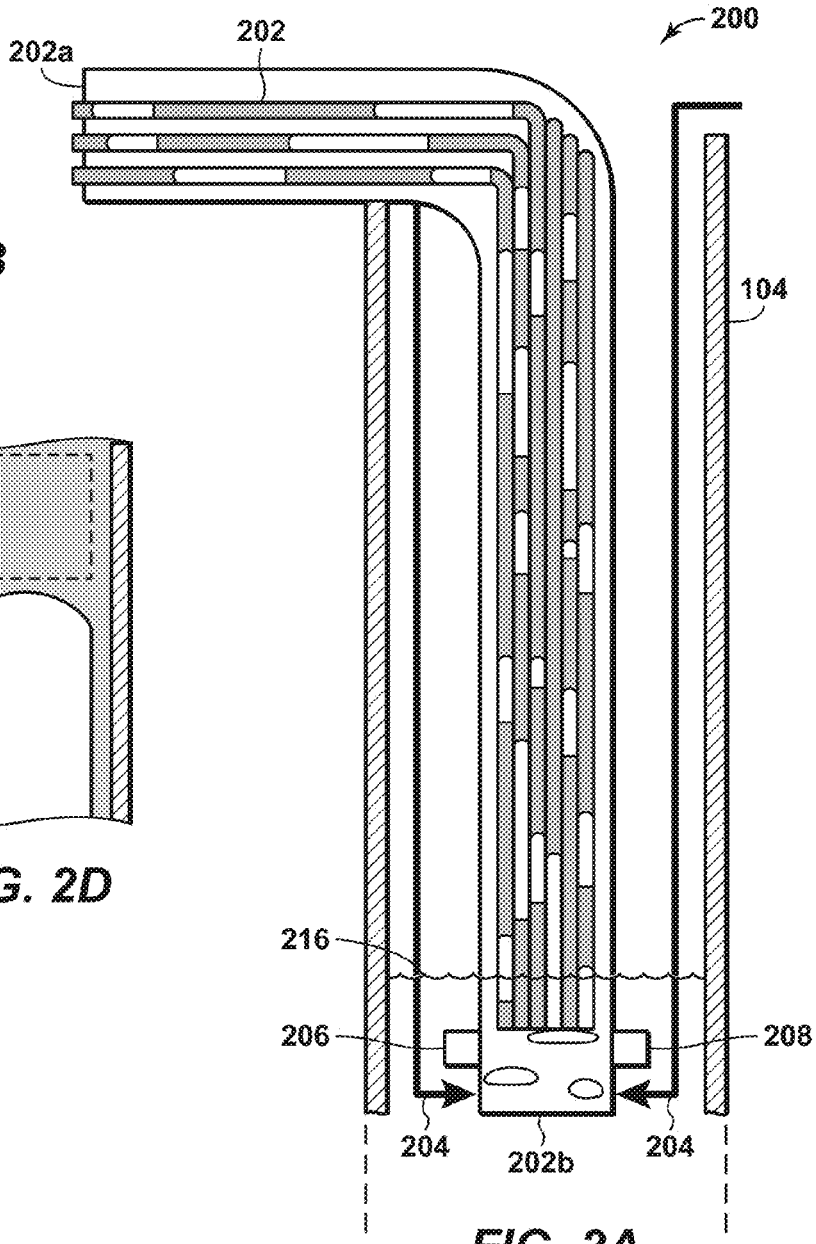
FIG. 2A is an exemplary schematic of a bubble pump device inserted into a vertical riser.

FIG. 2A is an exemplary schematic of a bubble pump device inserted into a vertical riser 104, together can constitute a flow assurance system 200. Removal of the liquid column in a vertical riser 104 is achieved by inserting a bundle of capillary tubes 202 into the riser 104 for use as a bubble pump device. The present technological advancement may be used with conventional risers, but can also be used with risers configured to a have a specially designed access port for inserting the tube bundle 202.

FIG. 2B is an exemplary cross-section of an output end of the bubble pump device 203, which illustrates how the tubes in the tube bundle 202 may be distributed. The amount and distribution of the tubes can vary depending upon the particular application.

The liquid column 216 in the riser 104 is removed by generating gas near the entry of the tube bundle 202. The gas will rise due to buoyancy effects and will enter the tube dragging with it liquids which it carries up the tube bundle 202.

Figure 2C:
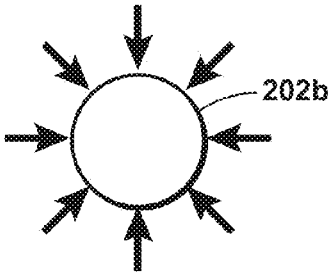
FIG. 2C is an exemplary cross-section illustrating gas injection.

The gas can be supplied by gas injection via tubes 204 (could use gas lift injection ports if they exist) and/or by heating liquids at the bottom of the riser. As shown in FIG. 2C, the gas may be generated circumferentially around an entry side of the tube bundle 202*b*. By heating the fluids, gas will evolve and generate vapor bubbles which will follow a trajectory up the tubes 204. The liquids can be collected topside and either directed towards a system separator or an additional liquid collection vessel. Once a desired amount of the liquid column is removed from the riser, the tubing bundle can be removed and operations can restart once the hydrate dissolves.

The entry side 202*b* of tube bundle 202 can be fitted with a pressure sensor 206 and/or a temperature sensor 208. The output side 202*a* of tube bundle 202 can be fitted with a flow sensor that monitors either the volume of liquid or flow rate of liquid being removed from riser 104. However, these sensors may be disposed in other locations as long as they obtain data that is useful to monitoring the dissolution of the hydrate or operation of the bubble pump. These sensors can be communicatively coupled to a computer on platform 100. The computer can monitor the readings from these sensors and control the positioning of the tube bundle 202 (i.e., by providing control signals to motors and/or other equipment to lower the tube bundle further into the riser 104), and/or the gas injection. The computer can control the position of the tube bundle in order to maintain the entry side of the tube bundle 202 in the liquid column so liquid can be removed from the riser until a desired pressure reduction on the topside of the hydrate is achieved.

Pressure on the backside of the hydrate blockage 110 can be reduced through bleeding gas pressure by opening valves 102*b* and 102*c*. The valves can be controlled via the computer in order to control the decrease in pressure on the backside of the hydrate blockage 110. The computer can monitor the pressure on the backside of the hydrate blockage 110 via a pressure sensor that can be disposed on the platform 100.

The computer can control the pressure decrease on both sides of the hydrate blockage in order to remediate the hydrate blockage 110 via dual side de-pressurization. The depressurization on both sides of the hydrate blockage 110 can be controlled to be within at least +/−10% of each other in order to avoid the hydrate blockage 110 becoming a projectile due to a pressure imbalance. For liquid loaded systems, pressure differentials can be as high as a couple 100 psid whereas systems that are gas dominated require lower pressure differentials.

The tube bundle 202 serves as conduits for liquid removal in such a way that in order to maintain high liquid-to-gas ratio, a capillary bubble two-phase flow is developed inside the tubes 204 (see, FIG. 2D, and vapor bubble 212 and displaced fluid 214). The importance of the capillary bubble flow is in the fact that the gas phase cannot travel significantly faster than the liquid phase due to its periodic structure. A comparison of the important gravitational and surface tension forces can be observed by using the Eotvos number for evaluation. For example, using water and gas as the fluids, the diameter of the tubes that would be needed to maintain gravitation and surface tension forces on the same order of magnitude. $Eo=1=\Delta\rho\ g\ D^2\ \sigma^{-1}$. Tube diameters on the order of 5 mm are needed.

The diameter of a vertical, round conduit containing a gas/liquid flow has a great influence on the extent with which the gas phase can slip past the liquid, given its much lower density and viscosity. It can be explained using two hypothetical extremes. At one extreme, one can consider a body of water, such as a lake, with compressed air being introduced from a one inch diameter hose at the bottom. The air will bubble up to the surface with an ever widening cross-sectional area. There is little net flow of water to the surface unless the volume of air is large. At the other extreme, one can consider gas rising through a small diameter pipe inside that same lake. For a given volume of gas introduced continuously at the bottom of the tube, the height of the liquid will increase with incremental decreases in the pipe diameter. This is true whether the flow regime is slug, churn or annular. It is well known in the production of oil to replace the production tubing with one having a smaller diameter in the later stages of the well's free flowing period. A smaller diameter reduces the ability of the gas to slip past the liquid.

There exists a two-phase flow regime where there is no slippage. It has a "periodic structure" where the flow becomes a series of closed systems having alternating layers of liquid and gas. It occurs in tubes of a small diameter and is called "capillary bubble flow". An explanation of this phenomenon is that gas bubbles rising in a liquid seek a. specific diameter through a balancing process of coalescence and breakup, given the surface tension of the liquid and the prevailing conditions such as pressure, temperature, etc. At some point, when the tube diameter is less than the bubble diameter, a "periodic structure", or "capillary bubble flow" occurs. Said another way, capillary bubble flow will be formed in tubes with a diameter small enough where the impact of the surface tension dominates the flow conditions. For example, for mixtures of water and air under ambient conditions, capillary bubble flow is established with a tube diameter of 7 millimeters, or 0.276 inches (according to Chisholm, D.: Two-phase Flow in Pipelines and Heat Exchangers, London, New York, G. Godwin in association with The Institution of Chemical Engineers, 1983, page 32).

Another characteristic of this "periodic structure" is that the continuity of the liquid phase is broken. As a result, Archimedes forces do not influence the interaction between the phases. This means that at any point in the column, the force of pressure exerted by the gas/liquid flow above will be based on the mass of the liquid, irrespective of its height. In other words, the pressure from above will be reduced by a factor equal to the percentage volume of the flow which is gas.

A result of achieving the capillary bubble flow pattern is that the height of the liquid column, or the hydrostatic head, is much higher than for any other two-phase flow regime experiencing equivalent conditions. Capillary bubble flow will occur in flows having gas volume percentages below 10% and above 90%. As the pressure declines up the well, the gas "period" of the flow will expand while the liquid "period" will stay the same size. Given the absence of slippage and the significant expansion of the gas as the pressure declines up the tubing (the volume doubles each time the hydrostatic pressure is halved—gas volume will expand by a factor of 8 when pressure declines from 1,000 psi to 125 psi), the height of the column can be increased dramatically.

Additional exemplary operational characteristics of a bubble pump are found in U.S. Pat. No. 5,904,209.

Figure 3A:
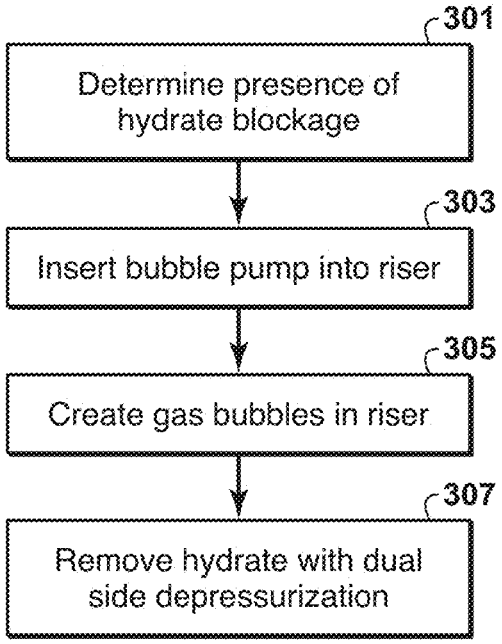
FIG. 3A is a flow chart for an exemplary method of remediating a hydrate blockage.

FIG. 3A is a flow chart for an exemplary method of remediating a hydrate blockage. In step 301, the presence of a hydrate blockage is determined. This may be determined by observing a loss of production and/or through simulation of conditions in the flow lines, which predicts/confirms the presence of a hydrate blockage. In step 303, a bubble pump is inserted into the riser. In step 305, gas bubbles are created below the end of the bubble pump. The gas bubbles can be created through gas injection or heating the liquid in the riser as discussed above. In step 307, the hydrate is removed through dual-side depressurization, wherein a computer controls the bleeding of pressure on a backside of the hydrate blockage concurrently with the liquid column in the riser being removed through use of the bubble pump.

Figure 3B:
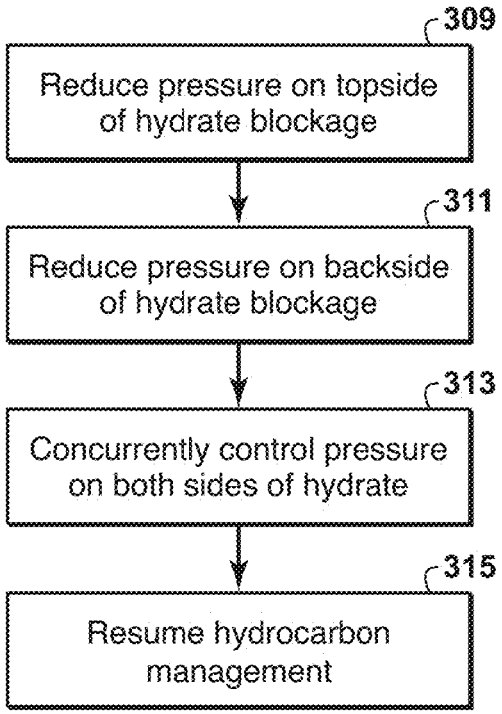
FIG. 3B is a flow chart for an exemplary method of dual-side depressurization.

FIG. 3B is a flow chart providing an example of dual-side depressurization. Step 309 includes reducing pressure on a topside of the hydrate blockage in the subsea flow line by removing liquid from within subsea riser with a bubble pump that has a first end in fluid communication with the liquid within the subsea riser. Step 311 includes reducing pressure on a backside of the hydrate blockage. Step 313 includes concurrently controlling the reduction in pressure on the topside of the hydrate blockage and the backside of the hydrate blockage. In step 315, after the hydrate has dissolved, hydrocarbon management can resume. As used herein, hydrocarbon management includes hydrocarbon extraction, hydrocarbon production, hydrocarbon exploration, identifying potential hydrocarbon resources, identifying well locations, determining well injection and/or extraction rates, identifying reservoir connectivity, acquiring, disposing of and/or abandoning hydrocarbon resources or produced fluids, reviewing prior hydrocarbon management decisions, and any other hydrocarbon-related acts or activities.

Figure 4:
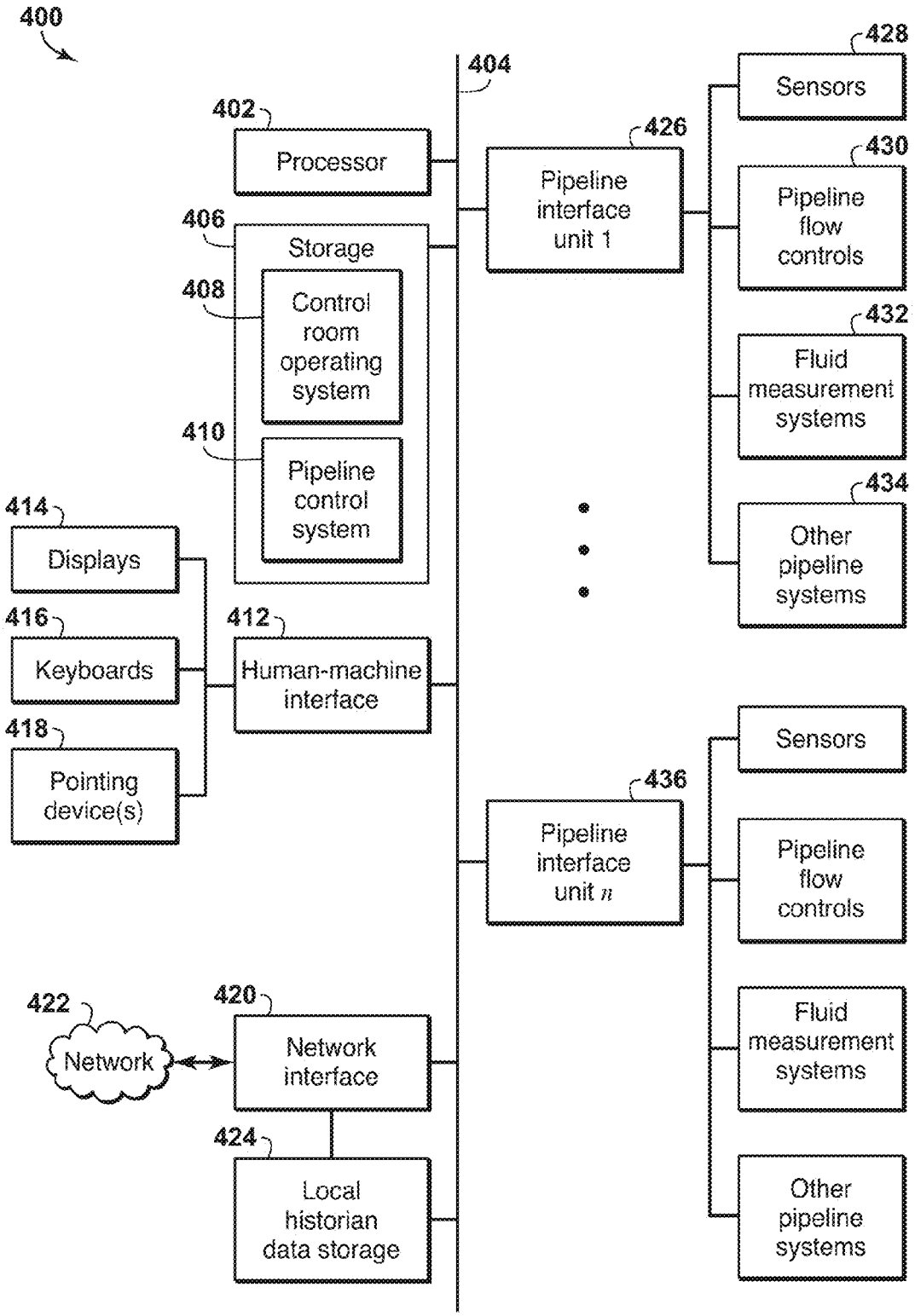
FIG. 4 is an exemplary a computer system.

FIG. 4 is an exemplary a computer useable with the present technological advancement. FIG. 4 is a schematic block diagram illustrating an exemplary control system 400 that may be used to implement flow assurance techniques. The control system 400 may be associated with the computer and associated sensors as previously described, and may be part of a larger system, such as a distributed control system (DCS), a programmable logic controller (PLC), a direct digital controller (DDC), or any other appropriate control system. Further, the control system 400 may automatically adjust parameters, or may provide information about the separation system to an operator who manually inputs adjustments. Additionally, any controllers, controlled devices, or monitored systems, including measuring devices, sensors, valves, actuators, and other controls, may be part of a real-time distributed control network, such as a FIELDBUS system. In an exemplary embodiment, the control system 400 can be used to increase or decrease the flow rates of production fluids, adjust amounts of additives injected into lines, individually or as an ensemble, and alert engineers of conditions flagged as potential flow assurance issues.

The control system 400 may have a processor 402, which may be a single core processor, a multiple core processor, or a series of individual processors located in systems through the plant control system 400. The processor 402 can communicate with other systems, including distributed processors, in the plant control system 400 over a bus 404. The bus 404 may be an Ethernet bus, a FIELDBUS, or any number of other buses, including a proprietary bus from a control system vendor. A storage system 406 can be coupled to the bus 404, and may include any combination of non-transitory computer readable media, such as hard drives, optical drives, random access memory (RAM) drives, and memory, including RAM and read only memory (ROM). The storage system 406 can store code used to provide operating systems 408 for a pipeline control room, as well as code to implement pipeline control systems 410, for example, based on the systems and methods discussed above.

A human-machine interface 412 may provide operator access to the pipeline control system 410, for example, through displays 414, keyboards 416, and pointing devices 418 located at one or more control stations. A network interface 420 can provide access to a network 422, such as a local area network or wide area network for a corporation. A local historian 424 can also be connected to the network interface 420. In an exemplary embodiment, the local historian 424 archives and updates data files related to the pipeline and the transported fluid, and those data files are utilized in subsequent flow assurance analyses disclosed herein.

A pipeline interface for a first unit 426 may provide measurement and control systems for a first pipeline system. For example, the pipeline interface 426 may read a number of sensors 428, such as the measurement devices 206 and 208, which are described with respect to FIG. 2. The pipeline interface 426 may also make adjustments to a number of controls, including, for example, pipeline fluid flow controls 430 used to adjust the flow rate of particular flow lines throughout the pipeline system. The flow controls 430 can be used, for example, to adjust the actuator on a flow adjusting device or valve. The pipeline interface for a first unit 426 may exercise control based in part on indications made by fluid measurement systems 432, including phase level detectors, gas hydrate sensors, temperature, pressure and volume data, for example. The pipeline interface 426 can control other pipeline systems 434, including systems for injecting certain additives that help ensure flow rates of production fluids in the pipeline system are continuous.

This control system 400 can also be used by the local production units to send a particular request through the system. For example, if there was an unplanned shutdown and the operators want to know how to restart or if there will be potential issues, they can push a higher-priority job into the system, and the system 400 will automatically run the flow assurance predictions from the current situation to provide guidance for local engineers making the analyses. This will significantly reduce lag time and also control the use of hydrodynamic models and flow assurance tools globally. Another example includes a production unit that wants to bring on another well or commingle fluids. The fluid properties tools can be updated using the methods described with respect to FIGS. 3A and B, and the request for commingling fluid lines could be analyzed. The flow assurance system 200 of FIG. 2 can perform the analysis and flag any potential issues with commingling the fluids, including potential issues concerning scale, or the formation of asphaltenes, hydrates, wax, or other solid particles. Communication between the flow assurance system 200 and the corresponding control system 400 ensures that commands based on further analysis of fluid properties and flow lines are implemented when desirable.

It will be understood that the pipeline control system 400 shown in FIG. 4 has been simplified to assist in explaining various embodiments of the present techniques. The control system 400 is not limited to a single pipeline interface 426. If more flow lines are added, additional pipeline interfaces 436 may be included to control those new pipeline units, and to maintain an up-to-date global profile on the network 422 and network server (not shown). Further, the distribution of functionality is not limited to that shown in FIG. 4. Different arrangements could be used, for example, one pipeline interface system could operate several different measurement sections of pipeline and pipeline headers, while another pipeline interface system could operate controller systems, and yet another interface could operate other systems related to flow assurance within the pipeline. Accordingly, in embodiments of the present techniques numerous devices not shown or specifically mentioned can further be implemented. Such devices can include flow meters, such as orifice flow meters, mass flow meters, ultrasonic flow meters, and venturi flow meters, as an example. Additionally, compressors, tanks, heat exchangers, sensors, and sand traps can be utilized in further embodiments, separately or in addition to the units shown.

The present techniques may be susceptible to various modifications and alternative forms, and the examples discussed above have been shown only by way of example. However, the present techniques are not intended to be limited to the particular examples disclosed herein. Indeed, the present techniques include all alternatives, modifications, and equivalents falling within the spirit and scope of the appended claims.

What is claimed is:

1. A method, comprising:

performing dual-side depressurization on a hydrate blockage in a subsea flow line, wherein dual-side depressurization includes, reducing pressure on a topside of the hydrate blockage in the subsea flow line by removing liquid from within a subsea riser with a tube bundle having a plurality of capillary tubes, the tube bundle having a first end in fluid communication with the liquid within the subsea riser, wherein the subsea riser is in fluid communication with the subsea flow line, and wherein the liquid is removed from the subsea riser through the plurality of capillary tubes from the first end to a second end of the tube bundle, reducing pressure on a backside of the hydrate blockage, and concurrently controlling the reduction in pressure on the topside of the hydrate blockage and the backside of the hydrate blockage.

2. The method of claim 1, wherein the concurrently controlling includes maintaining a pressure differential on the topside and the backside of the hydrate blockage within a predetermined range.

3. The method of claim 2, wherein the predetermined range is +/−10%.

4. The method of claim 1, wherein the concurrently controlling includes reducing the pressure on the topside and the backside of the hydrate blockage by about 200 psi.

5. The method of claim 1, wherein the reducing pressure on the topside of the hydrate blockage includes controlling a position of the tube bundle within the riser to maintain fluid communication between the first end of the tube bundle and the liquid within the riser as the liquid is removed from the riser.

6. The method of claim 1, wherein the reducing pressure on the backside of the hydrate includes bleeding gas from the flow line.

7. The method of claim 1, further comprising injecting a gas below the first end of the tube bundle.

8. The method of claim 7, wherein the injecting the gas includes injecting the gas through gas injection ports disposed in the riser.

9. The method of claim 1, further comprising heating the liquid in the riser to generate gas bubbles below the first end of the tube bundle.

10. The method of claim 9, wherein the heating the liquid in the riser includes heating at a bottom of the riser.

11. The method of claim 1, further comprising resuming hydrocarbon management after the hydrate blockage dissolves.

12. The method of claim 1, wherein the removing liquid comprises developing capillary bubble flow inside the plurality of capillary tubes.

13. The method of claim 1, wherein each of the plurality of capillary tubes has a diameter of about 7 millimeters.

14. The method of claim 1, wherein each of the plurality of capillary tubes has a diameter of about 5 millimeters.

* * * * *